US006998583B2

(12) United States Patent
Yang et al.

(10) Patent No.: US 6,998,583 B2
(45) Date of Patent: Feb. 14, 2006

(54) ELECTRIC COOKING APPARATUS AND METHOD OF CONTROLLING THE SAME

(75) Inventors: Hay Yeong Yang, Suwon (KR); Jong Gun Kim, Hwasung (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 34 days.

(21) Appl. No.: 10/787,136

(22) Filed: Feb. 27, 2004

(65) Prior Publication Data

US 2005/0051533 A1 Mar. 10, 2005

(30) Foreign Application Priority Data

Sep. 9, 2003 (KR) ..... 10-2003-0063004

(51) Int. Cl.
*H05B 3/02* (2006.01)

(52) U.S. Cl. ..... 219/483; 219/490

(58) Field of Classification Search ..... 219/482, 219/483, 486, 490, 497, 507, 518, 508, 462.1, 219/466.1, 543, 476, 477; 323/236
See application file for complete search history.

(56) References Cited

U.S. PATENT DOCUMENTS

| | | | | |
|---|---|---|---|---|
| 4,010,412 | A * | 3/1977 | Forman | 219/486 |
| 5,352,864 | A * | 10/1994 | Schultheis et al. | 219/448.17 |
| 5,616,266 | A * | 4/1997 | Cooper | 219/543 |
| 5,973,298 | A * | 10/1999 | Kallgren | 219/543 |
| 6,242,722 | B1 * | 6/2001 | Provancha et al. | 219/543 |
| 6,598,600 | B1 | 7/2003 | Köllner | 126/211 |

* cited by examiner

*Primary Examiner*—Tu Hoang
(74) *Attorney, Agent, or Firm*—Staas & Halsey LLP

(57) ABSTRACT

An electric cooking apparatus and a method of controlling the same are disclosed. The electric cooking apparatus includes heating units, a switching unit, a current detecting unit and a control unit. The heating units each having a heating element and electrodes connected to the heating element. The switching unit switches power to be applied to the electrodes. The current detecting unit detects values of current output from the heating units. The control unit operates a predetermined number of the heating units, which are determined according to the values of current detected from the current detecting unit after operating the heating units.

26 Claims, 6 Drawing Sheets

ELECTRIC COOKING APPARATUS AND METHOD OF CONTROLLING THE SAME

CROSS-REFERENCE TO RELATED APPLICATIONS

This application claims the benefit of Korean Patent Application No. 2003-63004, filed on Sep. 09, 2003 in the Korean Intellectual Property Office, the disclosure of which is incorporated herein by reference.

BACKGROUND OF THE INVENTION

1. Field of the Invention

The present invention relates, in general, to an electric cooking apparatus, and more particularly, to an electric cooking apparatus and method of controlling the same which heats a cooking container put on a cooking plate using heating units located under the cooking plate, and cooks food.

2. Description of the Related Art

Generally, an electric cooking apparatus is an apparatus which converts electric energy into thermal energy, and heats and cooks food using the thermal energy.

Generally, the electric cooking apparatus includes a body casing. A heating device is placed in the body casing to provide heat. Additionally, a cooking plate is mounted on an upper part of the body casing to allow a cooking container to be put thereon. A mark is indicated at a location of the cooking plate corresponding to the heating device so that a user puts the cooking container thereon.

However, a conventional electric cooking apparatus is inconvenient in that the user must put the cooking container at a pre-designated location on the cooking plate corresponding to the heating device because the location of the conventional heating device is fixed.

Furthermore, the conventional electric cooking apparatus is problematic in that unnecessary energy loss is incurred if the cooking container is not precisely located at the pre-designated location on the cooking plate corresponding to the heating units.

SUMMARY OF THE INVENTION

Accordingly, it is an aspect of the present invention to provide an electric cooking apparatus and method of controlling the electric cooking apparatus, which allow a heating position to be automatically changed according to a location and size of a cooking container located on a cooking plate.

Additional aspects and/or advantages of the invention will be set forth in part in the description which follows and, in part, will be obvious from the description, of may be learned by practice of the invention.

The foregoing and/or other aspects are achieved by providing an electric cooking apparatus, comprising heating units each heating unit having a heating element and electrodes connected to the heating element, a switching unit to switch power applied to the electrodes, a current detecting unit to detect values of current output from the heating units, and a control unit to operate a predetermined number of the heating units, which are determined according to the values of current detected from the current detecting unit after operating the heating units.

It is another aspect of the present invention to provide an electric cooking apparatus, including heating units each heating unit having a heating element and electrodes connected to the heating element, a switching unit to switch power to be supplied to the electrodes, and a control unit to separately operate the heating units by operating the switching unit.

It is another aspect of the present invention to provide a method of controlling an electric cooking apparatus, an electric cooking apparatus having heating units each heating unit having a heating element and electrodes connected to the heating element, and a switching unit to switch power to be applied to the electrodes, the method comprising detecting values of current output from the heating units after operating the heating units, and operating a predetermined number of heating units determined according to the detected values of current.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
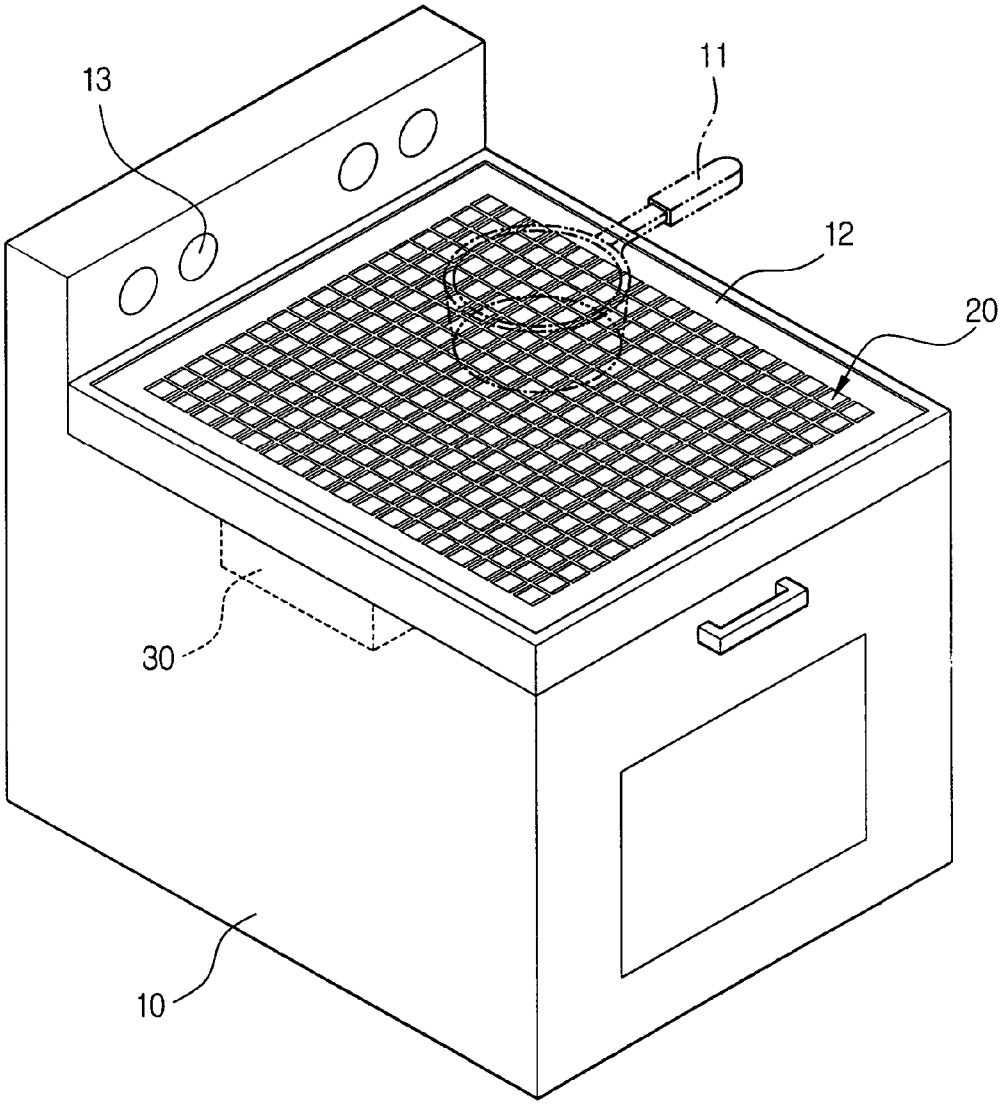
FIG. 1 is a perspective view of an electric cooking apparatus, according to the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

FIG. 1 is a perspective view of an electric cooking apparatus, according to the present invention. In FIG. 1, the electric cooking apparatus of the present invention comprises a body casing 10. A cooking plate 12, on which a cooking container 11 is located, is mounted on an upper part of the body casing 10 Heating units 20 are located in the body casing 10 under the cooking plate 12 and provide heat to the cooking plate 12. The heating units 20 are operated by a control device 30. Furthermore, a plurality of control buttons 13 are provided on one side of the body casing 10 to input commands to the control device 30 to operate the heating units 20.

The user causes the electric cooking apparatus to perform cooking by operating the heating units 20 using relevant control buttons 13 after putting the cooking container 11 on the cooking plate 12.

Figure 2:
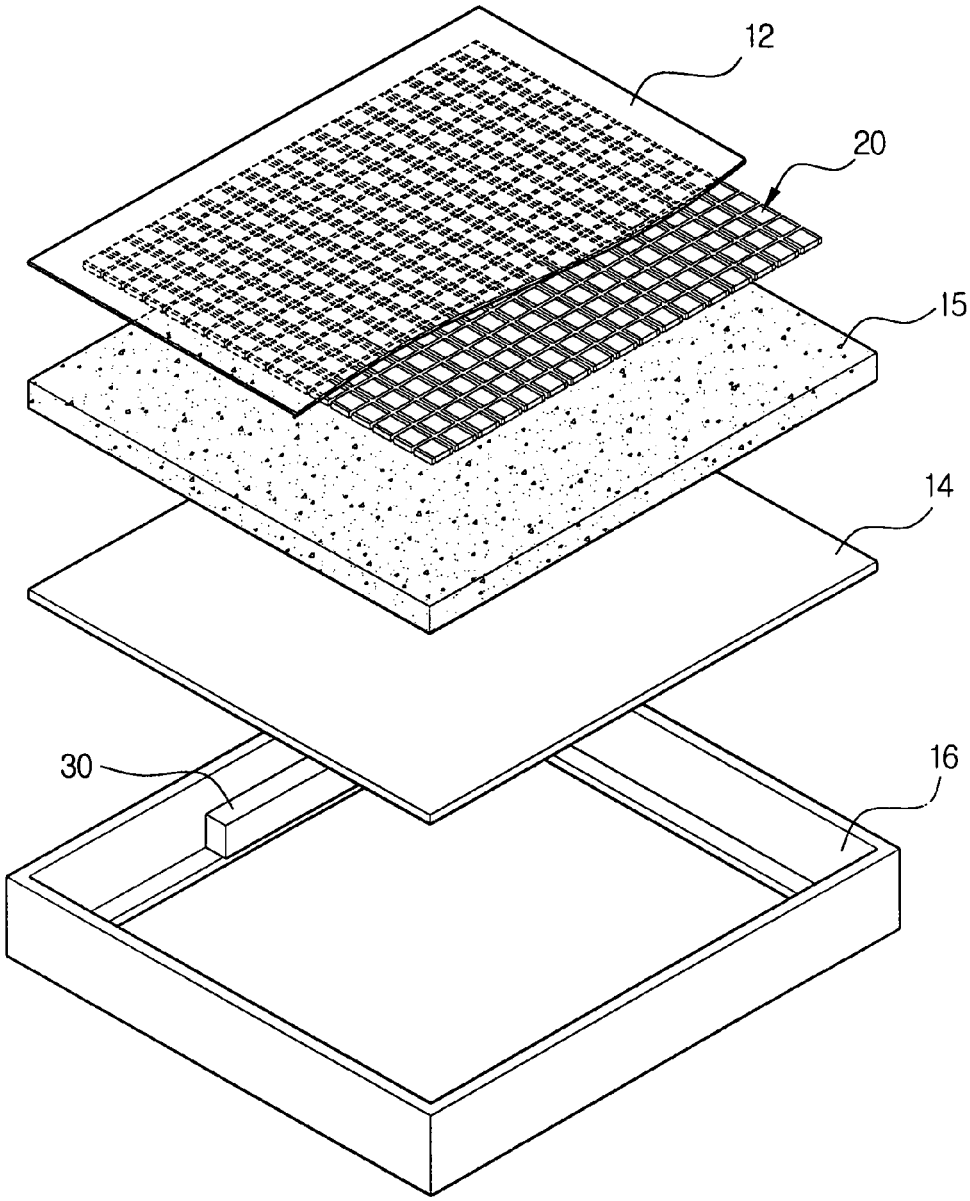
FIG. 2 is an exploded perspective view showing main components of the electric cooking apparatus of FIG. 1.
Figure 3:
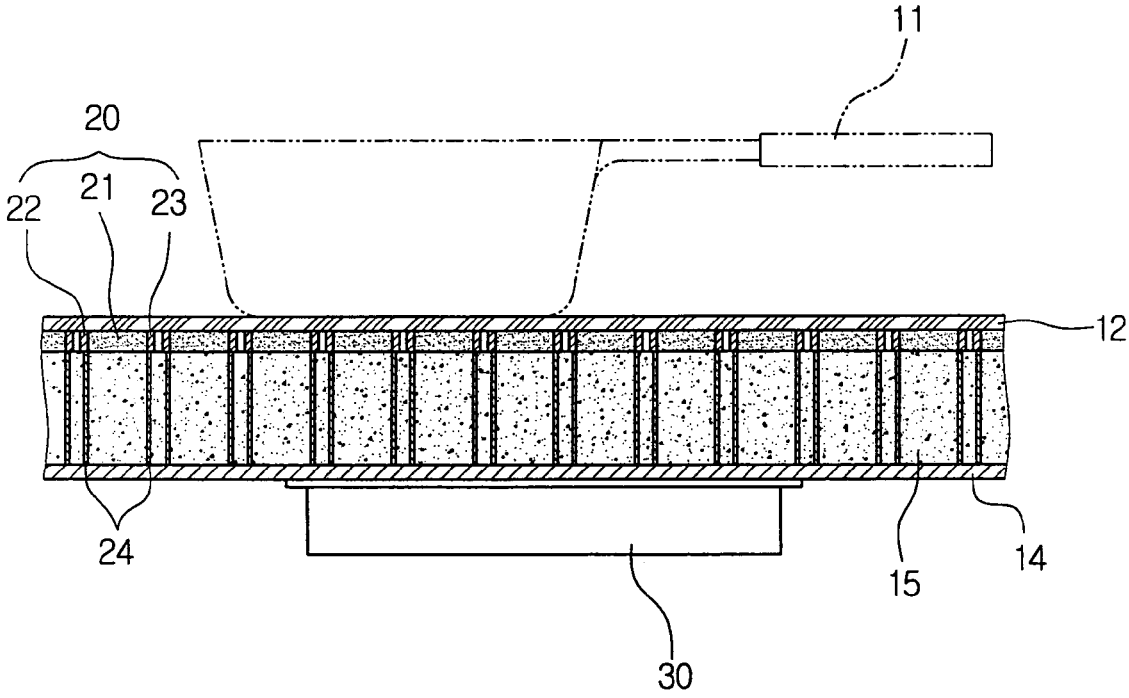
FIG. 3 is a front view showing assembled main components of the electric cooking apparatus of FIG. 1.

FIG. 2 is an exploded perspective view showing main components of the electric cooking apparatus of FIG. 1. FIG. 3 is a front view of the assembled main components of the electric cooking apparatus of FIG. 1. In FIGS. 2 and 3, an electric cooking apparatus comprises a thermally conductive cooking plate 12 to allow the cooking container 11 to be located thereon. The thermally conductive cooking plate 12 is made of a ceramic glass.

The heating units 20 which provide heat to a lower part of the cooking plate 12 are located under the cooking plate 12 at predetermined intervals. A heat-insulating material 15 is located under the heating units 20, and a support plate 14 is located under the heat-insulating material 15. Furthermore, a support frame 16 is located around the support plate 14 to support the control device 30 which operates the heating units 20.

Each of the heating units 20 comprises a sheet-heating element 21 formed by printing a heat-generating paint under the thermally conductive cooking plate 12 in rectangular cells, and a pair of electrodes 22 and 23 connected to both ends of the sheet-heating element 21, respectively, to supply power thereto.

Each of the electrodes 22 and 23 of the heating units 20 is electrically connected to the control device 30 through an electrical connecting member 24.

Accordingly, the control device 30 may operate the heating units 20 separately or in groups by supplying or cutting off power to the electrodes 22 and 23, so that not only an entire region but also a localized region of the cooking plate 12 may be used as a cooking region.

Furthermore, each of the heating units 20 operate as a heating element and a location-detecting sensor which detects a location and size of the cooking container 11, details of which will be described later.

Figure 4:
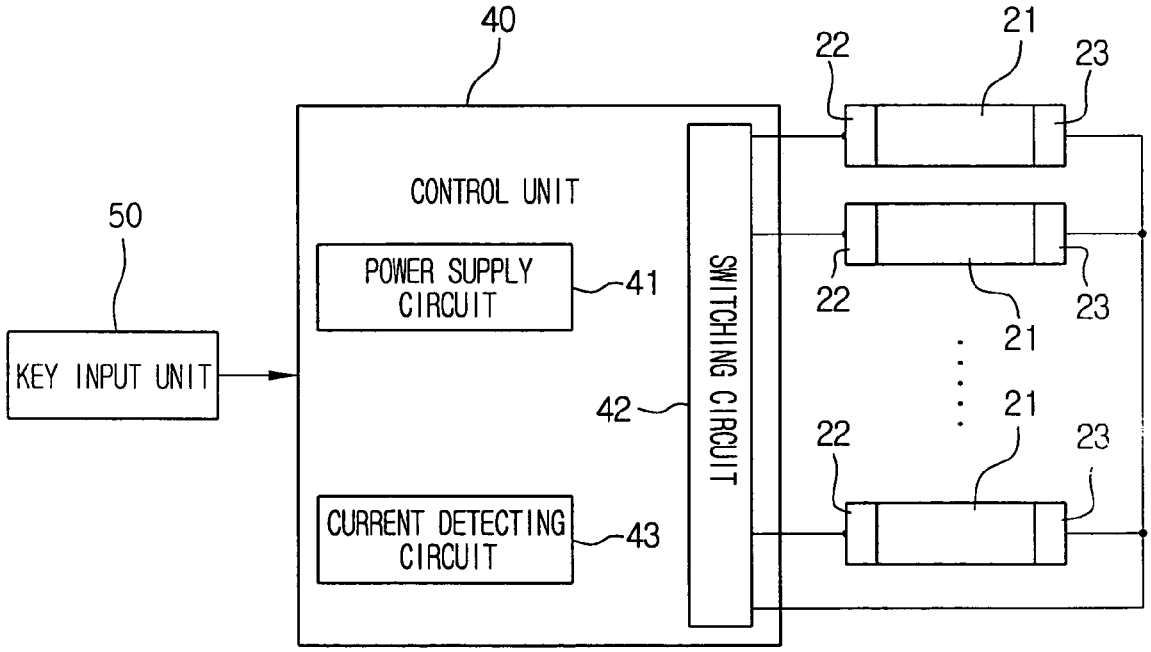
FIG. 4 is a control block diagram of the electric cooking apparatus, according to the present invention.

FIG. 4 is a control block diagram, according to the present invention. In FIG. 4, the electric cooking apparatus of the present invention comprising a control unit 40 to perform overall control.

A key input unit 50 having the plurality of control buttons 13 to receive cooking commands from the user is electrically connected to an input side of the control unit 40.

Furthermore, the heating units 20 connected in parallel to each other are electrically connected to an output side of the control unit 40. An (−) electrode 23 of each of the heating units 20 is connected to the control unit 40 as a common electrode, and an (+) electrode 22 thereof is connected to the control unit 40.

Furthermore, the control unit 40 comprises a power supply circuit 41 to supply a certain amount of power thereto, a switching circuit 42 to switch the power supplied from the power supply circuit 41 to respective electrodes, and a current detecting circuit 43 to detect changes in current in the heating units 20 supplied with the power.

Generally, a rate of change of resistance of the sheet-heating element 21 changes depending on whether the cooking container 11 exists at a location of the cooking plate 12 corresponding to the sheet-heating element 21 inside the heating unit 20. Accordingly, depending on whether the cooking container exists, a value of current in the heating unit 20 is changed by the sheet-heating element 21. Therefore, the control unit 40 supplies the power to each of the heating units 20 through the switching circuit 42 subsequently, detects the change of current in each of the heating units 20 through the current detecting circuit 43, and analyzes the rate of change of current, so that whether the cooking container 11 exists at the location of the cooking plate 12 corresponding to each of the heating units 20 may be recognized and the location and size of the cooking container 11 may be detected.

Figure 5:
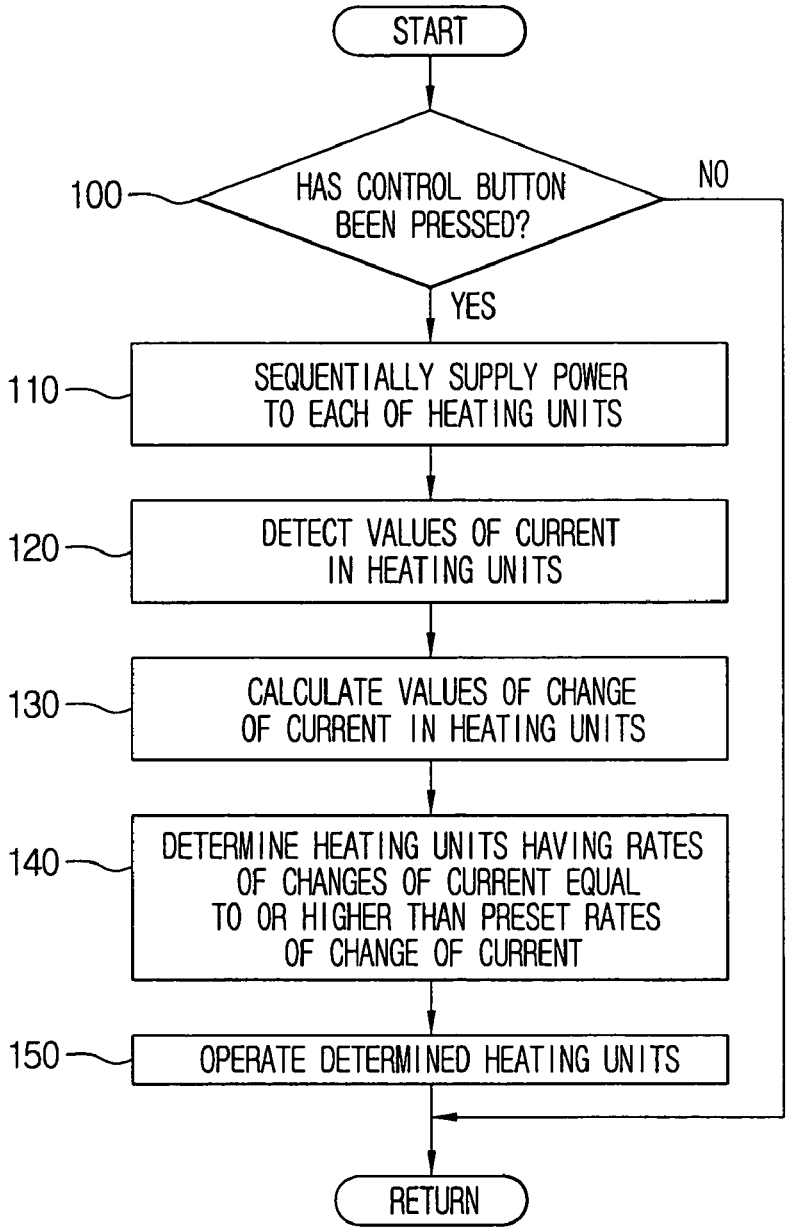
FIG. 5 is a control flowchart showing a method of controlling the electric cooking apparatus, according to the present invention.

FIG. 5 is a control flowchart showing a method of controlling the electric cooking apparatus, according to the present invention. In FIG. 5, the user puts food into the cooking container 11 and places the cooking container 11 on the cooking plate 12.

The control unit 40 determines whether the control button 13, which operates the electric cooking apparatus, has been pressed by the user in operation 100.

When it is determined that the control button has been pressed, the control unit 40 determines the heating units 20 corresponding to a location and size of the cooking container 11, and operates the determined heating units 20.

To determine the heating units 20 corresponding to the location and size of the cooking container 11, the control unit 40 sequentially supplies power through the switching circuit 42 to sequentially operate the heating units 20 in operation 110. After sequentially supplying the power to the heating units 20, the control unit 40 detects values of current in the heating units 20 through the current detecting circuit 43 for a certain period of time in operation 120. As described above, when the power is applied to the electrodes 22 and 23 of the heating units 20, the sheet-heating elements 21 generate heat. Since rates of change of resistance of the sheet-heating elements 21 are different depending on whether the cooking container 11 exists or not at the location of the cooking plate 12, the rates of change of current detected by the current detecting circuit 43 vary with time. In operation 130, the control unit 40 calculates the rates of change of current based on the values of current detected in the operation 120. Additionally, in operation 140, the control unit 40 determines the heating units 20 having rates of change of current equal to or higher than a preset rate of change of current. Accordingly, when the rate of change of current of each of the heating units 20 is equal to or higher than the preset rate of change of current, the cooking container 11 is located on the location of the cooking plate 12 corresponding to the heating units 20. As a result, when the heating units 20 having the rates of change of current are operated, only a portion of the cooking plate 12 on which the cooking container 11 is located, is heated.

Thereafter, in operation 150 the control unit 40 operates the heating units 20 determined in operation 140. Consequently, the control unit 40 operates the heating units 20 which correspond to the location and size of the cooking container 11, so that unnecessary energy loss may be reduced.

Figure 6:
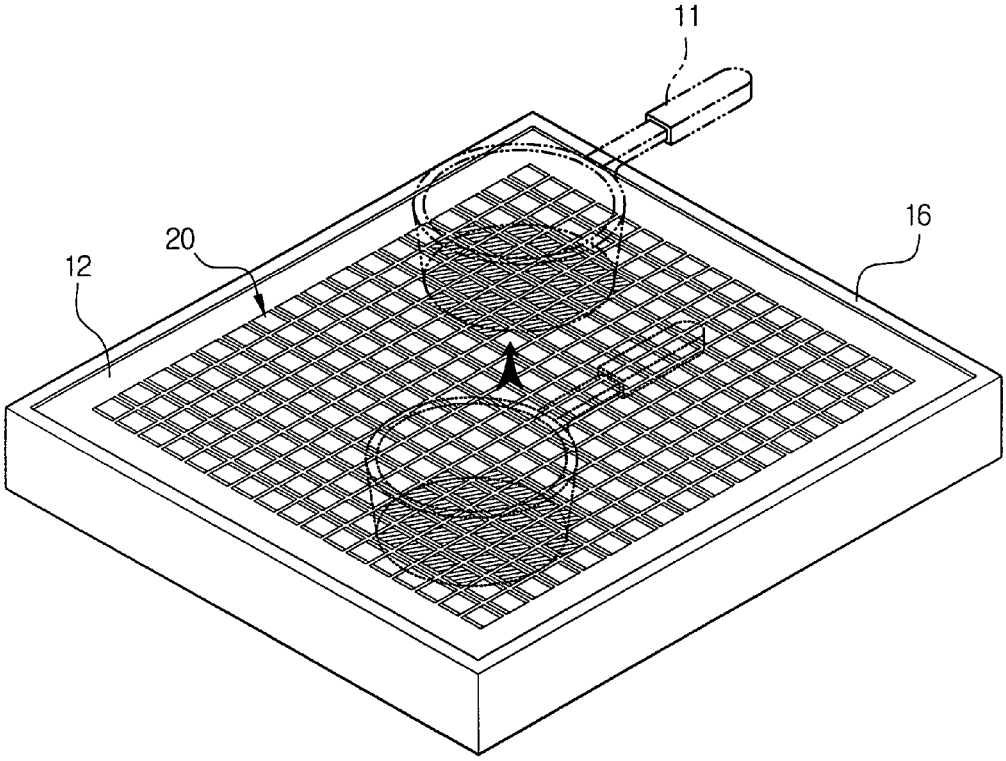
FIG. 6 is a view showing that a heating location is changed when the cooking container is moved to another location.

The control unit 40 periodically determines whether the cooking container exists on the cooking plate 12 in a same manner as described above while operating the heating units 20. If the cooking container 11 is moved to another location, as shown in FIG. 6, the control unit 40 detects the new location and then operates the heating units 20 corresponding to the detected new location. Furthermore, if another cooking container is placed on the cooking plate 12, the control unit 40 periodically determines whether the cooking container 11 exists on the cooking plate 12 by checking remaining heating units except for heating units 20 currently being operated, and automatically and additionally operates the heating units 20.

As described above in detail, the electric cooking apparatus may heat the cooking container without regard to the location of the cooking container on the cooking plate, so that convenience for the user is improved.

Furthermore, the electric cooking apparatus heats only the portion of the cooking plate in contact with the cooking container without regard to the size of the cooking container, so that the present invention reduces unnecessary energy loss.

Although a few preferred embodiment of the present invention have been shown and described, it would be appreciated by those skilled in the art that changes may be made in this embodiment without departing from the principles and spirit of the invention, the scope of which is defined in the claims and their equivalents.

What is claimed is:

1. An electric cooking apparatus, comprising:

heating units, each heating unit having a heating element and electrodes connected to the heating element;

a switching unit to switch power applied to the electrodes in each heating unit;

a current detecting unit to detect values of current in the heating units; and a control unit to operate a predetermined number of the heating units, which are determined according to the values of current detected from the current detecting unit after operating the heating units.

2. The electric cooking apparatus of claim 1, further comprising a thermally conductive cooking plate wherein the heating units are printed in independent cells under the thermally conductive cooking plate which allows a cooking container to be located thereon.

3. The electric cooking apparatus of claim 2, further comprises a heat-insulating material located under the heating units.

4. The electric cooking apparatus of claim 2, wherein the heating units are printed under a total area of the cooking plate.

5. The electric cooking apparatus claim 1, wherein:

the control unit calculates rates of change of current in the heating units according to the values of current detected from the current detecting unit.

6. The electric cooking apparatus of claim 5, further comprising a microprocessor to operate the predetermined number of heating units determined according to the calculated rates of change of current.

7. An electric cooking apparatus comprising:

heating units, each heating unit having a heating element and electrodes connected to the heating element;

a switching unit to switch power applied to the electrodes in each heating unit;

a current detecting unit to detect values of current in the heating units;

a control unit to operate a predetermined number of the heating units, which are determined according to the values of current detected from the current detecting unit after operating the heating units, and calculates rates of change of current in the heating units according to the values of current detected from the current detecting unit; and a microprocessor to operate the predetermined number of heating units determined according to the calculated rates of change of current, wherein the microprocessor determines the heating units having output rates of change of current equal to or higher than a preset rate of change of current to determine whether a cooking container is located on the electric cooking apparatus, and operates the predetermined number of the heating units.

8. A method of controlling an electric cooking apparatus, an electric cooking apparatus having heating units, each heating unit having a heating element and electrodes connected to the heating element, and a switching unit to switch power to be applied to the electrodes in each heating unit, the method comprising:

detecting values of current in the heating units after operating the heating units; and operating a predetermined number of the heating units determined according to the detected values of current.

9. The method of claim 7, further comprising:

calculating rates of change of current of the heating units according to the detected values of current; and detecting whether a cooking container to be heated by the heating units is located in the electric cooking apparatus according to the calculated rates of change of current.

10. The method of claim 8, wherein:

determining the predetermined number of heating units having output rates of change of current equal to or higher than a preset rate of change of current; and operating the predetermined number of heating units.

11. An electric cooking apparatus, comprising:

heating units, each heating unit having a heating element and electrodes connected to the heating element;

a switching unit to switch power to be supplied to the electrodes in each heating unit;

a current detecting unit to detect values of current in the heating units; and a control unit to separately operate the heating units by operating the switching unit, according to the values of current detected from the current detecting unit after operating the heating units.

12. The electric cooking apparatus of in claim 11, wherein a heat-insulating material is located under the heating units.

13. The electric cooking apparatus of in claim 11, further comprising a thermally conductive cooking plate wherein the heating units are printed in independent cells under the thermally conductive cooking plate which allows a cooking container to be located thereon.

14. The electric cooking apparatus of claim 12, wherein the heating units are printed under a total area of the cooking plate.

15. The electric cooking apparatus of claim 2, wherein the heating units provide heat to a lower part of the cooking plate and are located under the cooking plate at predetermined intervals.

16. The electric cooking apparatus of claim 3, further comprising a support plate located under the heat-insulating material, wherein a support frame is located around the support plate to support the control unit which operates the heating units.

17. An electric cooking apparatus comprising:

heating units, each heating unit having a heating element and electrodes connected to the heating element;

a switching unit to switch power applied to the electrodes in each heating unit;

a current detecting unit to detect values of current in the heating units;

a control unit to operate a predetermined number of heating units, which are determined according to the values of current detected from the current detecting unit after operating the heating units; and a thermally conductive cooking plate wherein the heating units are printed in independent cells under the thermally conductive cooking plate which allows a cooking container to be located thereon, and each of the heating units comprises a sheet-heating element formed by printing a heat-generated paint under the cooking plate in the independent cells.

18. The electronic cooking apparatus of claim 17, wherein the electrodes are connected to an end of the sheet-heating element, respectively to supply power thereto.

19. The electric cooking apparatus of claim 1, further comprising an electrical connection member, wherein each of the heating units is electrically connected to the control unit through the electrical connection member.

20. The electric cooking apparatus of claim 1, further comprising a key input unit having a plurality of control buttons is electrically connected to an input side of the control unit to receive cooking commands from a user.

21. The electric cooking apparatus of claim 1, wherein the control unit operates the heating units separately.

22. The electric cooking apparatus of claim 1, wherein the control unit operates the heating units in groups by supplying and cutting off power to the electrodes.

23. An electric cooking apparatus comprising:

heating units, each heating unit having a heating element and electrodes connected to the heating element;

a switching unit to switch power applied to the electrodes in each heating unit;

a current detecting unit to detect values of current in the heating units; and a control unit to operate a predetermined number of the heating units, which are determined according to the values of current detected from the current detecting unit after operating the heating units, wherein each of the heating units detects a location and a size of a cooking container.

24. The electric cooking apparatus of claim 1, wherein the heating units are connected in parallel to each other and are electrically connected to an output side of the control unit.

25. The electric cooking apparatus of claim 2, wherein the thermally conductive cooking plate is made of a ceramic glass material.

26. An electric cooking apparatus comprising:

heating units, each heating unit having a heating element and electrodes connected to the heating element;

a switching unit to switch power applied to the electrodes in each heating unit;

a current detecting unit to detect values of current in the heating units; and a control unit to operate a predetermined number of heating units, which are determined according to the values of current detected from the current detecting unit after operating the heating units; and a thermally conductive cooking plate wherein the heating units are printed in independent cells under the thermally conductive cooking plate which allows a cooking container to be located therein, wherein when the cooking container is moved to another location, the control unit detects the location and operates the predetermined number of heating units corresponding to the detected location.

* * * * *

UNITED STATES PATENT AND TRADEMARK OFFICE

CERTIFICATE OF CORRECTION

PATENT NO. : 6,998,583 B2
APPLICATION NO. : 10/787136
DATED : February 14, 2006
INVENTOR(S) : Ha Yeong Yang et al.

It is certified that error appears in the above-identified patent and that said Letters Patent is hereby corrected as shown below:

Col. 5, Line 31, after “apparatus” insert --of--.
Col. 6, Line 30, after “apparatus of” delete “in”.
Col. 6, Line 32, after “apparatus of” delete “in”.
Col. 8, Line 15, after “units” delete “and”.

Signed and Sealed this

Twenty-fourth Day of October, 2006

JON W. DUDAS
*Director of the United States Patent and Trademark Office*